US007811211B2

(12) United States Patent
Habing

(10) Patent No.: US 7,811,211 B2
(45) Date of Patent: Oct. 12, 2010

(54) SINGLE APPARATUS CONVERGING/DIVERGING EXERCISE MACHINE

(76) Inventor: Douglas J. Habing, 3008 Volk, Long Beach, CA (US) 90808

( * ) Notice: Subject to any disclaimer, the term of this patent is extended or adjusted under 35 U.S.C. 154(b) by 826 days.

(21) Appl. No.: 10/632,129

(22) Filed: Jul. 31, 2003

(65) Prior Publication Data

US 2004/0162195 A1 Aug. 19, 2004

Related U.S. Application Data

(60) Provisional application No. 60/447,666, filed on Feb. 14, 2003.

(51) Int. Cl.
*A63B 21/00* (2006.01)
*A63B 69/06* (2006.01)
*A63B 21/078* (2006.01)

(52) U.S. Cl. ..... 482/100; 482/72; 482/136; 482/138

(58) Field of Classification Search ..... 482/97–100, 482/136–138, 133, 142, 72, 92–94, 135
See application file for complete search history.

(56) References Cited

U.S. PATENT DOCUMENTS

| | | | | |
|---|---|---|---|---|
| 1,547,268 A | | 7/1925 | Sotomayor | |
| 4,323,236 A | | 4/1982 | Szabo | |
| 4,344,619 A | | 8/1982 | Szabo | |
| 4,478,411 A | * | 10/1984 | Baldwin | 482/136 |
| 4,564,193 A | | 1/1986 | Stewart | |
| 4,765,613 A | | 8/1988 | Voris | |
| 4,784,384 A | | 11/1988 | Deola | |
| 4,856,773 A | | 8/1989 | Deola | |
| 4,923,195 A | | 5/1990 | Calderone | |
| 4,949,951 A | | 8/1990 | Deola | |
| 5,044,632 A | * | 9/1991 | Jones | 482/138 |
| 5,050,873 A | | 9/1991 | Jones | |
| 5,058,884 A | | 10/1991 | Fuller, Sr. | |
| 5,120,289 A | | 6/1992 | Yu | |
| 5,135,449 A | | 8/1992 | Jones | |
| 5,184,991 A | | 2/1993 | Brangi | |
| 5,217,422 A | * | 6/1993 | Domzalski | 482/138 |

(Continued)

FOREIGN PATENT DOCUMENTS

AT 397619 B * 4/1994

(Continued)

OTHER PUBLICATIONS

Hammer Strength, Iso-Lateral Chest Press/Lat Pulldown, Picture Price List, Apr. 1994.*

(Continued)

*Primary Examiner*—Loan Thanh
*Assistant Examiner*—Victor K Hwang
(74) *Attorney, Agent, or Firm*—Lewis, Rice & Fingersh, L.C.

(57) ABSTRACT

Principles of exercise machine construction, an exercise machine, components of an exercise machine, and methods related to exercising on or constructing an exercise machine that allows for the performance of multiple different exercises, where the user utilizes related arcs of an arm with a fixed path of motion for the different exercises. Generally the arcs will be utilized for both pull-type exercises and push-type exercises and/or for diverging and converging exercises.

13 Claims, 12 Drawing Sheets

U.S. PATENT DOCUMENTS 5,250,013 A * 10/1993 Brangi ..... 482/98
5,254,067 A 10/1993 Habing et al.
5,299,993 A 4/1994 Habing
5,330,405 A 7/1994 Habing et al.
5,336,153 A 8/1994 Chen
5,342,270 A * 8/1994 Jones ..... 482/98
5,417,633 A 5/1995 Habing
5,417,634 A 5/1995 Habing
D359,326 S 6/1995 Deola
5,435,798 A 7/1995 Habing et al.
5,437,589 A 8/1995 Habing
5,499,956 A 3/1996 Habing et al.
5,554,086 A 9/1996 Habing et al.
5,554,089 A * 9/1996 Jones ..... 482/97
5,562,577 A 10/1996 Nichols, Sr. et al.
5,580,341 A * 12/1996 Simonson ..... 482/100
5,597,257 A 1/1997 Habing
RE35,470 E 3/1997 Jones
5,637,063 A 6/1997 Fuller, Sr.
5,658,223 A 8/1997 Habing et al.
5,665,036 A 9/1997 Hsieh
5,667,464 A 9/1997 Simonson
5,681,247 A 10/1997 Webber
5,683,334 A * 11/1997 Webber ..... 482/100
5,803,882 A 9/1998 Habing et al.
5,807,219 A 9/1998 Webber et al.
5,810,701 A 9/1998 Ellis et al.
5,885,193 A 3/1999 Habing et al.
5,897,459 A 4/1999 Habing et al.
5,897,467 A 4/1999 Habing et al.
5,916,072 A 6/1999 Webber
5,938,574 A 8/1999 Webber
5,944,641 A 8/1999 Habing
5,957,817 A 9/1999 Koenig et al.
5,961,427 A 10/1999 Habing et al.
5,967,954 A 10/1999 Habing
5,971,895 A 10/1999 Habing
5,997,447 A 12/1999 Giannelli et al.
6,004,247 A 12/1999 Webber
6,010,437 A 1/2000 Jones
6,071,216 A 6/2000 Giannelli et al.
6,080,091 A 6/2000 Habing et al.
6,120,419 A 9/2000 Huang
6,142,917 A 11/2000 Giannelli et al.
D444,190 S * 6/2001 Webber ..... D21/675
6,254,516 B1 7/2001 Giannelli et al.
6,302,833 B1 10/2001 Ellis et al.
6,394,936 B1 5/2002 Voris
6,579,213 B1 * 6/2003 Webber et al. ..... 482/100
6,605,022 B2 * 8/2003 Webber ..... 482/138
6,656,092 B1 * 12/2003 Fulks ..... 482/45
6,682,466 B1 * 1/2004 Ellis ..... 482/142
6,824,505 B1 * 11/2004 Chang ..... 482/95
7,717,833 B1 * 5/2010 Nelson et al. ..... 482/100
2002/0052268 A1 5/2002 Morcillo-Quintero et al.
2002/0107117 A1 * 8/2002 Carter ..... 482/100
2002/0119871 A1 * 8/2002 Fulks ..... 482/93
2003/0004043 A1 * 1/2003 Deola ..... 482/142
2003/0166439 A1 * 9/2003 Giannelli ..... 482/100

FOREIGN PATENT DOCUMENTS

DE 9110785 U1 * 11/1991
DE 29705989 U1 * 9/1998
ES 2028738 A6 * 7/1992
TW 317755 * 10/1997

OTHER PUBLICATIONS

Brochure, "The Brute, a Home Gym for Serious Strength Trainging", Tuff Stuff, 2002.
Web Site-http://www.tuffstuff.net/welcome/retail/products/home_equip/brtl/index.html. Printed Sep. 4, 2003.
Web Site-http://www.paramountfitness.com/showroom/page_fit5000.html. Printed Nov. 7, 2003.
Advertisement-Magnum Fitness Systems, "Let the Race Begin".
Brochure, Body Solid, Built for Life-EMX2000S, EXM2550S, EXM2750S, EXM3000LPS and EXM4000S dated Aug. 2002.
Official Show Program, Conference: Oct. 14-17, 1998 and Exhibits: Oct. 15-17, 1998, Club Industry 1998.
National Fitness Trade Journal, Spring of 1999, Body Masters' New CX Series.
National Fitness Trade Journal, Winter of 1998, "Introducing a Whole New Breed, Flite", p. 4-6.
Cybex Strength Systems advertisement for VR2, No. 4510 and 4715.
Brochure, Flite, Abench dated 1998.
Brochure, MedX Exercise dated Oct. 1998.
Biangular Technology, Selectorized Home Gym advertisement.
Web Site-http://www.lifefitness.com/product_detail.asp?id=hs_mts_latrow&type=innovations printed Jul. 1, 2002.
Paramount Fitness Corp. advertisement "Whats NEW in Strenght Training".

* cited by examiner

SINGLE APPARATUS CONVERGING/DIVERGING EXERCISE MACHINE

CROSS REFERENCE OF RELATED APPLICATION(S)

The application claims priority of United States Provisional Patent Application 60/441,666 filed Feb. 14, 2003 the entire disclosure of which is herein incorporated by reference.

BACKGROUND

1. Field of the Invention

This disclosure relates to the field of exercise machines. In particular, to exercise machines designed to perform different exercises (such as converging and diverging or push and pull strength exercises) with arms which follow a fixed or guided path.

2. Description of the Related Art

Over recent years, as physical fitness has become an ever more popular pursuit, there have evolved a plurality of exercise machines upon which exercises can be performed by a user. One type of exercise machine is the strength machine which is designed to improve muscle strength and tone by having the user utilize certain muscle groups to pull, push or otherwise perform work on some type of resistance mechanism built into the machine.

As the nature of exercise has become more fully understood, different types of exercise machines have been developed to provide for more effective training. Originally, strength training was performed by the lifting of free-weights. While simple to understand and operate, free-weights had inherent dangers in their use, and, although conceptually simple, were often hard to use correctly without trained instruction. In order to get the best toning or shaping results out of particular exercises, it is desirable that muscle groups be isolated so that the intended muscle group is exercised by the exercise, as opposed to exercising an unintended muscle group. With free-weights it was often not possible to perform exercises that isolated the desired muscle groups, and even if it was possible, it was often difficult to know how to perform the exercises correctly without specific instruction. As strength machines have evolved, they have tried to improve both the safety of performing different exercises, and the effectiveness of the exercise to isolate different muscle groups.

To most effectively isolate and exercise particular muscle groups, it is desirable that the exercise machine be arranged so that the user is limited in their motion to that which effectively performs the desired exercise on the desired muscle groups. This is generally performed by the selection and arrangement of two components of the machine. Firstly, there is a bench, seat or other structure which supports the user's body. For some exercises, this may be as simple as the floor upon which the machine rests, while for others adjustable benches may be provided to position portions of the user's body relative to appropriate pieces of the exercise machine. This component helps to get the user in a comfortable position where they can operate the moving portions of the machine, and place them in a position relative to the moving parts of the machine so that they manipulate those parts to perform the exercise.

The other component is the moving portion of the machine and is generally in the form of "arms" or other objects which are arranged in a manner to be engaged by the user at a certain point (such as a grip or handle), and then be moved by the user along a predetermined path or a guided path resisted by the machine. When the two components of the machine are used together correctly, the user is therefore positioned in such a manner that when the grip is moved by the user on the bench, the predetermined or guided path dictates the motion of the handle and, if the machine is well-designed, exercises the intended muscle group. This results in the user both isolating a muscle group and performing a safer exercise motion.

The difficulty with the design of strength machines, however, is that they generally need to be both flexible to perform multiple exercises, and limited to guide a user to perform an exercise correctly. As more has become known about the motion of particular exercises, this has led to a difficulty in finding exercise motions which can be incorporated into the same machine. Specifically, different types of exercise generally have different motions of the grips or handles and therefore the arms need to have different paths. With free-weights, the user can freely position the weights relative to their body, allowing them to perform numerous exercises, but at the same time, the user is not guided to perform any of the exercises correctly because the weights can be freely maneuvered. Strength machines, on the other hand, can often be designed to guide the particular motion of the user, but this limits the number of exercises which can be performed on the machine. This is particularly problematic when space for exercise machines is limited, such as for most individuals in their homes, and even for the majority of gyms or workout facilities.

One significant problem which has existed with strength machines is to incorporate both push-type and pull-type exercises in the same machine, without the inclusion of multiple sets of arms for the user to interact with significantly increasing the complexity of the machine. For instance, when exercising the upper torso it is desirable to perform push-type exercises where the arms are pushed away from the body against resistance and pull-type exercises where the arms are pulled toward the body against resistance.

The duality of exercise discussed above exists because muscle groups generally operate in pairs. In particular, individuals generally have two sets of muscles which operate in conjunction with each other. One set acts to move in one direction, while the other acts to move in the opposing direction. Since muscle generally performs work by contracting, the two muscle groups act in concert with one group contracting (performing work) while the other group expands (essentially resting).

To increase strength and/or tone in any particular muscle region (set of two or more muscle groups such as the torso) it is therefore desirable to be able to perform different types of exercise motions. This, however, requires a machine capable of providing resistance to both a push and pull motion (or to motion in different directions) to related or different muscle groups. A difficulty arises because many resistance mechanisms generally only provide resistance to motion in one direction (e.g. the resistance is opposing the lifting of a weight from its resting position, as compared to returning it to its resting position). The commonality of this type of resistance has generally required exercise machines that provide a user with both push and pull motion to either have additional arms for each exercise so that the arms can follow different paths—which necessarily increase their size, expense and complexity—or to have complex mechanisms for the arm motion allowing users to connect and disconnect components to accomplish different exercises. This leads to increased difficulty of construction and use, increased expense, and often an increased risk of failure.

Further, the range of motion utilized when a user is performing a pull motion is often different from the range of motion of a user performing a push motion with a related muscle group. For example, a user performing a chest press will generally begin the exercise with their hands near their chest, however in the corresponding rowing movement, the user will often end the exercise with their arms lower, near their upper mid-section. This difference exists even though the general motion of both exercises is basically perpendicular to the plane of the body and may exist due to differing rotation in the arms or hands when performing the different exercises comfortably.

Still further, exercises are generally not performed using static patterns where the hands maintain a constant position relative to each other, but are preferably carried out with the hands either converging on each other or diverging from each other.

SUMMARY

Because of these and other previously unknown problems in the art, disclosed herein are principles of exercise machine construction, an exercise machine, components of an exercise machine, and methods related to exercising on and constructing an exercise machine that allows for the performance of multiple different exercises, particularly upper torso strength exercises, where the user utilizes related arcs of motion of an arm in a fixed or guided path for the different exercises. Generally the arcs will be utilized for both pull-type exercises and push-type exercises and/or for diverging and converging exercises.

Described herein in an embodiment is, a method of exercising comprising: providing an exercise machine including: a frame; a resistance object; a first arm moveably attached to the frame, the first arm also being connected to the resistance object; at least two handle manipulation points on the first arm; having a user take a first position relative to the frame, the first position defining a plane of symmetry about which the user is generally symmetrical when in the first position; having the user move a handle located at the first handle manipulation point in a first motion relative to the plane of symmetry, the first motion being resisted by the resistance object; having a user take a second position, wherein the user's torso is reversed relative to the torso in the first position, the second position placing the user so that the user is generally symmetrical to the plane of symmetry; having the user move a handle located at the second handle manipulation point in a second motion relative to the plane of symmetry, the second motion being resisted by the resistance object; selecting the first motion and the second motion so that: both the first motion and the second motion converge to the plane of symmetry, both the first motion and the second motion diverge from the plane of symmetry, the first motion converges to the plane of symmetry and the second motion diverges from the plane of symmetry, or the first motion diverges from the plane of symmetry and the second motion converges to the plane of symmetry.

In an embodiment the method further comprises: including within the exercise machine: a second arm moveably attached to the frame, the second arm also being connected to the resistance object; at least two handle manipulation points on the second arm; having the user in the first position also move a handle located at a first handle manipulation point on the second arm in a third motion relative to the plane of symmetry, the third motion being resisted by the resistance object; and having the user in the second position also move a handle located at a second handle manipulation point on the second arm in a fourth motion relative to the plane of symmetry, the fourth motion being resisted by the resistance object; selecting the third motion and the fourth motion so that: both the third motion and the fourth motion converge to the plane of symmetry, both the third motion and the fourth motion diverge from the plane of symmetry, the third motion converges to the plane of symmetry and the fourth motion diverges from the plane of symmetry, or the third motion diverges from the plane of symmetry and the fourth motion converges to the plane of symmetry. In an embodiment, the first arm and the second arm can move independently of the motion of the other, the motion of the first arm and the motion of the second arm are dependent, the first motion, the second motion, the third motion, and the fourth motion comprise rotation about an axis, the first motion and the second motion comprise rotation about a different axis from the third motion and the fourth motion, the third motion is symmetrical to the first motion relative to the plane of symmetry, and/or the fourth motion is symmetrical to the second motion relative to the plane of symmetry.

In another embodiment, the first motion comprises a circular motion, the first motion comprises a linear motion, and/or the first motion comprises rotation about an axis. In another embodiment, the resistance object may comprise weights, an elastic object, a fluid device, a friction device, and/or an electromagnetic device.

In another embodiment the exercise machine further comprises a bench attached to the frame, the bench including a back portion and a seat portion, and wherein the back portion remains in substantially the same position when the user is in the first position as when the user is in the second position. In another embodiment the user changes position by rotating the torso 180 degrees. In another embodiment, the first motion comprises pulling or pushing and the second motion comprises pulling or pushing.

In another embodiment, the handle at the first manipulation point and the handle at the second manipulation point may comprise the same handle moveable between the first handle manipulation point and the second handle manipulation point, or may comprise different handles.

In another embodiment, the resistance object provides a one-way resistance or a two-way resistance. In another embodiment the user in the first position may perform a chest press exercise, a lateral pull exercise, a rowing exercise (either level, inclined, or declined), an incline press exercise, a shoulder press exercise, or a decline press exercise.

In a still further embodiment there is described herein, an exercise machine comprising: a frame; a resistance object; a first arm moveably attached to the frame such that the arm traverses a fixed path, the first arm also being connected to the resistance object; a second arm moveably attached to the frame such that the arm traverses a fixed path, the second arm also being connected to the resistance object; and at least two handle locations on each of the arms; wherein a user can manipulate a handle at one of the handle locations on each of the arms to perform a converging exercise resisted by the resistance object; and wherein the user can manipulate a handle at another of the handle locations on each of the arms to perform a diverging exercise resisted by the resistance object.

In a still further embodiment of the exercise machine the converging exercise comprises a push-type or pull-type exercise and/or the diverging exercise comprises a push-type or pull-type exercise.

In a still further embodiment, the handle at the handle location and the handle at the another handle location may comprise the same handle moveable between the handle location and the another handle location, or may comprise different handles.

In a still further embodiment the movement of a handle at one location may cause the movement of a handle at another location. The first arm and second arm may move either independently or dependently of each other, may move rotationally about the same or different axes of rotation. Those axes of rotation may be parallel or non-parallel.

In a yet further embodiment, there is described an exercise machine comprising: a frame; a resistance object; an arm moveably attached to the frame such that the arm traverses a fixed path, the arm also being connected to the resistance object; at least two handle positions on the arm; wherein a handle located at a first handle position traces a first arc when moved, the first arc converging to a reference plane; and wherein a handle at the second handle position traces a second arc when moved, the second arc diverging from the reference plane. The movement of the first handle may cause movement of the second handle; and movement of the second handle may also cause movement of the first handle. The handle at the first handle position and the handle at the second handle position may comprise the same handle moveable between the first handle position and the second handle position, or may comprise different handles.

In a yet further embodiment, there is described an exercise machine comprising: a frame; a weight; a first arm rotatably attached to the frame such that the first arm rotates about a first pivot point; a second arm rotatably attached to the frame such that the second arm rotates about a second pivot point; a first set of at least two handles, a first handle of the first set attached to the first arm and a second handle of the first set attached to the second arm; and a second set of at least two handles, a first handle of the second set attached to the first arm and a second handle of the second set attached to the second arm; wherein a user manipulates the first set of handles to perform a converging exercise; and wherein the user manipulates the second set of handles to perform a diverging exercise.

In a still further embodiment the converging exercise is a push exercise and/or the diverging exercise is a pull exercise.

DETAILED DESCRIPTION OF PREFERRED EMBODIMENT(S)

Figure 1:
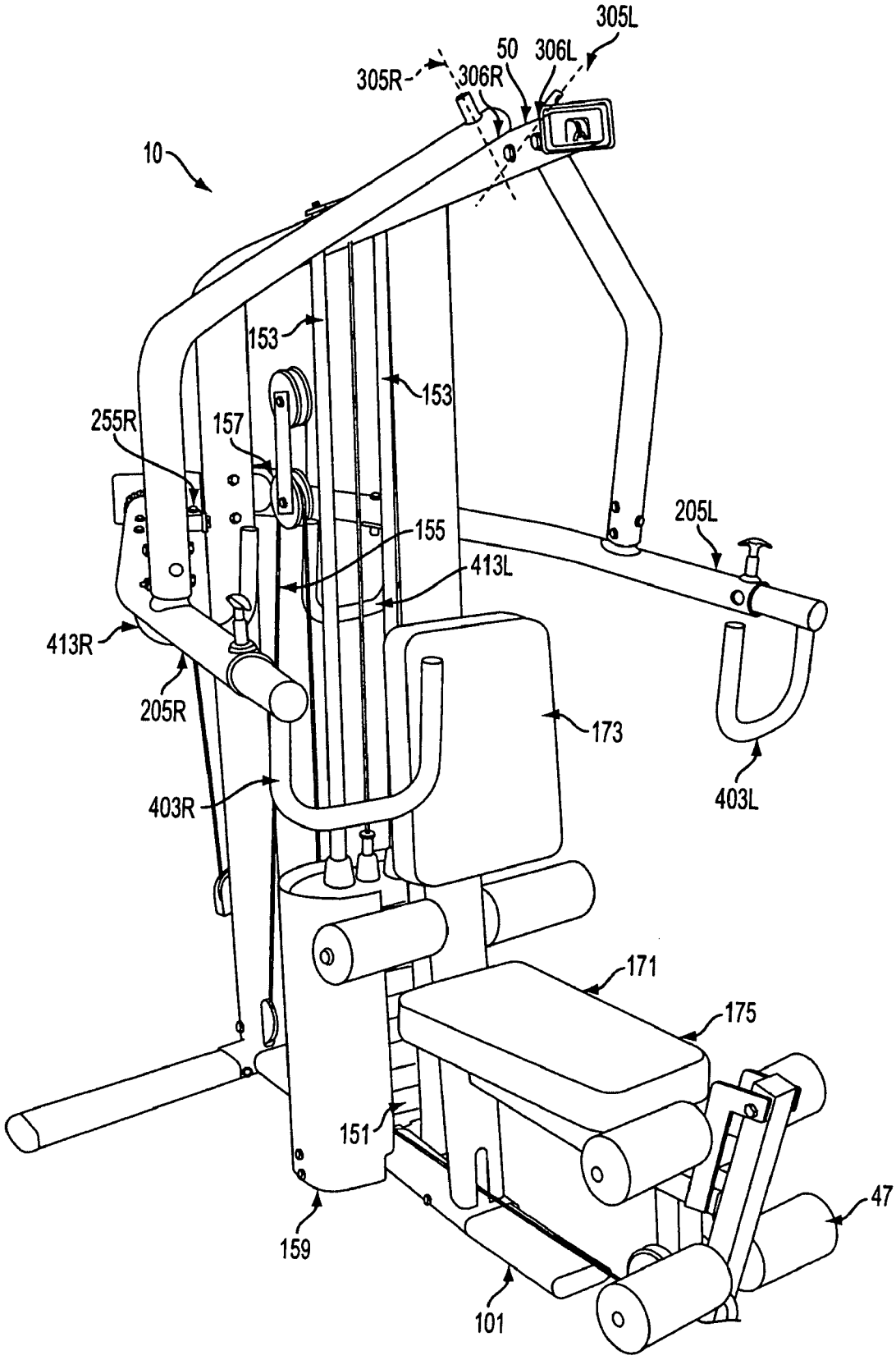
FIG. 1 depicts an embodiment of a perspective view of an exercise machine incorporating an embodiment of arms allowing for multiple types of exercises.

Although the exercise machines, arms, principles and methods described below are discussed primarily in terms of their application to a particular layout of exercise machine(s), one of ordinary skill in the art would recognize that the principles described herein can be used in a plurality of different exercise machines of different layouts designed to have certain desired footprints and space considerations. These can include, but are not limited to, home and commercial exercise machines of all price ranges.

Also, while the exercise machines are primarily discussed as performing torso and arm exercises, they could be readily adapted for use with other types of exercises and/or exercises involving other portions of the body (such as, but not limited to, the legs). Further, the embodiments disclosed herein generally discuss a user performing an exercise with both of their arms simultaneously. It would be understood that a user is not mandated to move both their arms simultaneously, therefore when an exercise is described as "converging" based on the different relationships of the hands to each other during the exercise, one of ordinary skill in the art would understand that the motion of a single hand, performing an identical motion, is also "converging."

Generally, a machine's motion will be used to refer to the available motion that can be traversed by the portion of the machine the user is intended to grasp or otherwise manipulate to perform the exercise (these will generally be "handles". The machine's motion therefore is interrelated to the motions the hands (in the case of a torso exercise) or other portions of the body make when using the machine. In most strength machines, the machine is designed so that the mechanisms can only move such that the user is guided to move the portion of the machine they interact with in a prescribed way (a particular "arc" of motion) to move the mechanisms at all. In this way, the available motion of the machine attempts to dictate that the user perform the exercise correctly.

The principles disclosed herein can generally be described as follows; the exercise machine allows for the performance of at least two different exercises which each utilize a portion of either the same arc of motion, or related arcs of motion where related arcs refer to arcs created by different locations on an arm which follows a fixed path. This fixed motion will often be, but is not limited to, rotational motion about a particular pivot axis. To put this another way, a part with a limited available range of motion can provide a wide variety of ranges of motion. Generally, the exercises performed herein utilize two arms (one for each side of the user's body) and herein each arm is a rigid or otherwise solid arm with a singular rotational, or similar, connection. This connection allows for the arm to follow a fixed path. The shape of the arm then provides different points where handles may be placed or otherwise arranged so the handles arranged at these points traverse appropriate related arcs at the appropriate position as the arm traces the fixed path.

Figure 8:
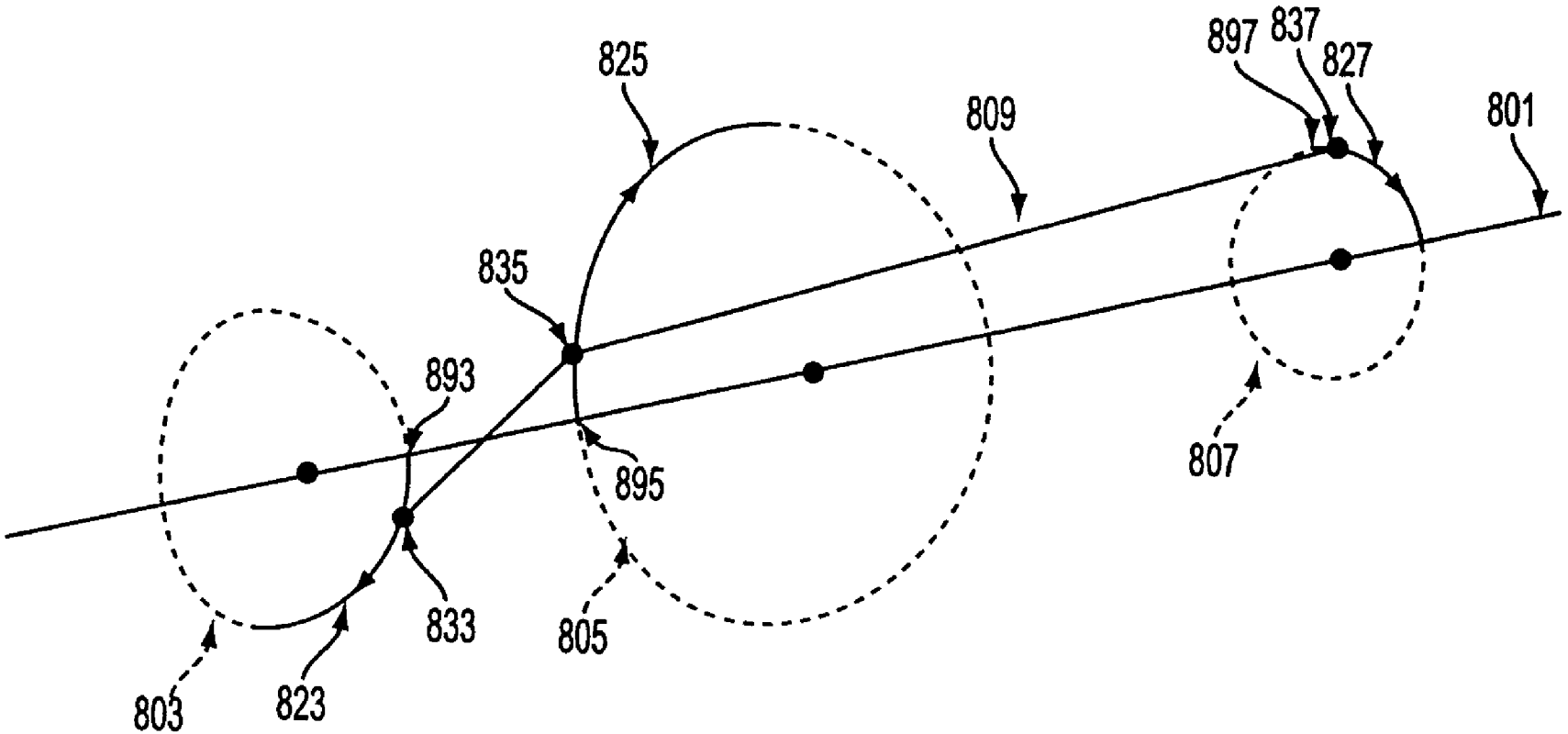
FIG. 8 depicts a representational drawing of an arm capable of moving in related arcs while following a fixed path.

This general principle is most clearly illustrated through the FIGS. Looking at FIG. 8, one can see an axis of rotation (801) shown. This axis of rotation (801) then defines a universe of circles which can be transcribed therearound. A small subselection of these circles are shown in FIG. 8 as circles (803), (805) and (807). As would be understood by one of ordinary skill in the art, a circle can be centered anywhere upon the axis of rotation (801), and may have any radius. Therefore, the illustrated circles are merely representative of circles which could be selected. Each of these circles can also be subdivided in any manner to form arcs (where an arc is a portion of a circle). Generally, these arcs will have proportional arc lengths, but in certain designs of an arm, may not. Three representative arcs are also shown in FIG. 8 as (823), (825), and (827). For purposes of this disclosure, each of these arcs are defined to be "related" because they can be traced by an arm following a fixed path. In this embodiment, the path would be rotational in a particular direction (as indicated by the arrows) about the axis of rotation (801), although in other embodiments other directions could be used.

FIG. 8 also shows a rigid arm (809) which can connect the related arcs (823), (825) and (827), such that points (which are positions of handles) on the arm (833), (835), and (837) will trace each of the arcs when the arm is rotated about the axis (801) in a designated direction (follows the fixed path of motion). From FIG. 8, it is clear that the trace of the arcs includes two positional references. In particular, each arc has a "starting point" (893), (895) or (897) which is where the handle begins before rotation, and that the rotation is in a defined singular direction about the axis. For ease of discussion, this direction is either "clockwise" or "counter clockwise." As should be apparent in FIG. 8, the related arcs can have different arc lengths simply because of the mathematical relationship of the radius to that arc and the angle that all the relative radiuses are moved through. Each related arc may or may not have the same angular relationship (although in most embodiments they will); it just simply means that an arm moving through a fixed path may transcribe a first arc and either a second arc, portion of a second arc, or the second arc plus some additional distance.

The representation of different arcs in FIG. 8 is a simplification of a more general relationship. In particular, two parts of a rigid body traversing a fixed path can actually be moving along differing related arcs relative to a fixed reference point. This can be further generalized in that so long as a non-rigid body (arm) can follow any fixed path, regardless of whether each point on the arm is moving in a similar relation to other points (such as in the case of FIG. 8) or if the points are moving relative to each other, points on that body can traverse related arcs. The "arc" generated by a handle can actually be of any shape and the "arc" is in no way limited to circular or smoothly curving shapes. For the purposes of this disclosure, the term "path" will refer to the path of motion that the arm can take and the term "arc" refers to the path taken by any point attached to or on that arm as the arm moves through its path regardless of the shape of the arc or path.

Exercise research has shown that exercise of the torso (and many other areas of the body) is generally desirable to not be static. That is, the motion of the hands is generally converging for some exercises (often those where the user pushes something away from their body) and diverging for other exercises (often those where the user pulls something toward their body) as this motion is much more natural to the user. Pull-type exercises and/or push-type exercises may either be converging or diverging exercises.

It is important to note what is meant by converging and diverging in the context of this disclosure. A converging exercise is performed when two symmetric parts of a user's body begin an exercise at a first distance apart and end that exercise at a second distance apart where the second distance is less than the first distance. A diverging exercise is performed when two parts of a user's body begin an exercise at a first distance apart and end that exercise at a second distance apart where the second distance is more than the first distance. In both cases, the change of distance is caused as part of the exercise by both body parts moving. Generally, the hands (the two parts of the user's body) in the push-type exercise begin separated and are moved closer together at the apex of the exercise (when the hands are extended from the body). Generally, in the pull-type exercise the hands begin close together (extended from the body) and are separated as the hands are pulled towards the body.

The definition of a converging and diverging exercise also holds true if it is being performed by a single body part so long as that body part is carrying out the same motion as it does in the above converging and diverging situation, even if the other body part does not move. To put this in another way, a converging exercise will generally have an arc converging toward the reference plane vertically dividing the human body into two generally symmetric halves (a plane of symmetry), a diverging exercise will have an arc diverging from the same plane. This plane will generally be through the midpoint of a user's body as shown in FIG. 7D by plane of symmetry (960). A converging exercise, therefore, generally represents a portion of the user's body converging towards the generally similar portion of the user's body across the plane of symmetry of the user's body. A diverging exercise is the opposite.

To get smooth motion in these types of exercises, the arc traversed by the hands is preferably arcuate or of a smooth linear translation in both exercise types which then leads to the desirable range of motion of an exercise machine (when properly used by a user) being guided to an arc the hands preferably take. For purposes of this disclosure, this smooth motion will be referred to as arcuate, although such motion may be linear. Because of the left/right symmetry generally present in the human body, the arcs are generally mirrored for the right and left hands about the midpoint of the user's body. One of ordinary skill in the art would recognize, however, that the path need not be arcuate in the plane of FIG. 7D. In FIG. 7D the arc is in the plane of the page so the motion appears curved. In another embodiment of the invention, the arc could be in a different plane so the motion of FIG. 7D could appear linear or any other shape. Essentially, the curved triangle shown in FIG. 7D would become two linear lines if the arc portion was perpendicular to the page. Further, an arc need not be a circular arc as shown, but could be and is not limited to, an elliptical arc, a parabolic arc, a hyperbolic arc, or a linear arc. Therefore, the arcuate motion simply describes a smooth path through 3-dimensional space.

Figure 7A:
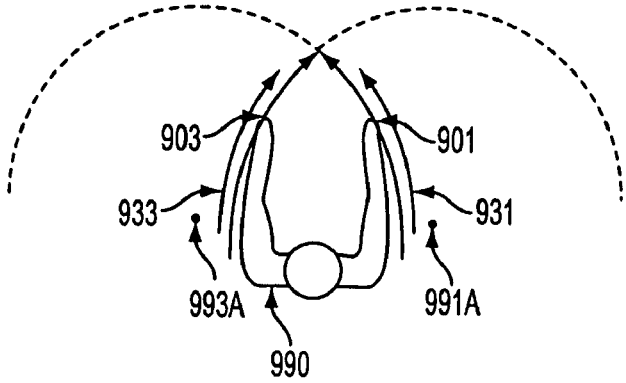
FIGS. 7A, 7B, 7C, and 7D depicts various general representations of motion for different type exercises.
Figure 7B:
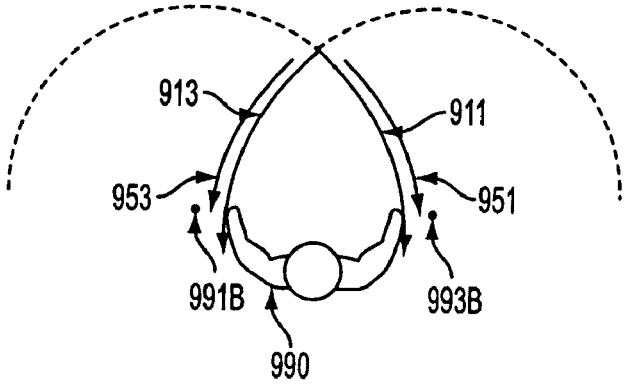

The relationship of the motion of the hands in a simplified push-type exercise and related pull-type exercise is shown in a simplified form in FIGS. 7A and 7B. In FIG. 7A there is shown the desired motion of a user (990), viewed from above (looking down at the top of their head), performing a push-type exercise (specifically a converging chest press), in FIG. 7B there is shown the desired motion of a user (990) performing a pull-type exercise (specifically a diverging rowing exercise).

Please note from the FIGS that the arcs shown here also include direction. In this case the direction refers to the direction the handle moves against resistance. Generally, when performing an exercise, a user will move in an arc against resistance, and then the handle will traverse over the same path to return to the starting point. Therefore, for clarity, the exercise arc or the path of the arm in this disclosure will always refer to a motion against a resistance. That is, the motion indicates a weight is lifted, not returned.

It is apparent from these FIGS, that the arcs (901), (911), (903), and (913) traced by the hands in each exercise are similar, in FIGS. 7A and 7B the motions are actually simplified to be the same, only the directions are different. A more general case will be discussed later in FIG. 7D. As shown, the left and right hands of the user traverse mirrored arcs in either exercise (for instance (901) and (903) in FIG. 7A). The hands do not necessarily, however, each track a part of the same circle. The arcs traversed by the hands may be on the same circle or separate circles, but it is generally preferable that the arcs be on intersecting circles that are not related; that is, there is an arc for each hand which is independent of the arc for the other hand. This is shown by the dashed circle outlines in FIGS. 7A and 7B. As the circles for each hand are not related, each circle has its own independent axis ((991A) and (993A) for FIG. 7A and (991B) and (993B) for FIG. 7B). These axes may or may not cross depending on the embodiment.

Also between exercises, the directions that the user (990) needs to provide the exercise force to get the intended exercise (represented by the arrows (931), (933), (951), and (953)) are reversed although the traces are the same. This shows that these are actually two different arcs. In particular, in the push-type exercise the user (990) is providing the exercise force (arrows (931) and (933)) along the arc in the direction away from the user's (990) body. While in the pull-type exercise, the exercising force (arrows (951) and (953)) is along a similar arc in a direction toward the user's (990) body.

Figure 7C:
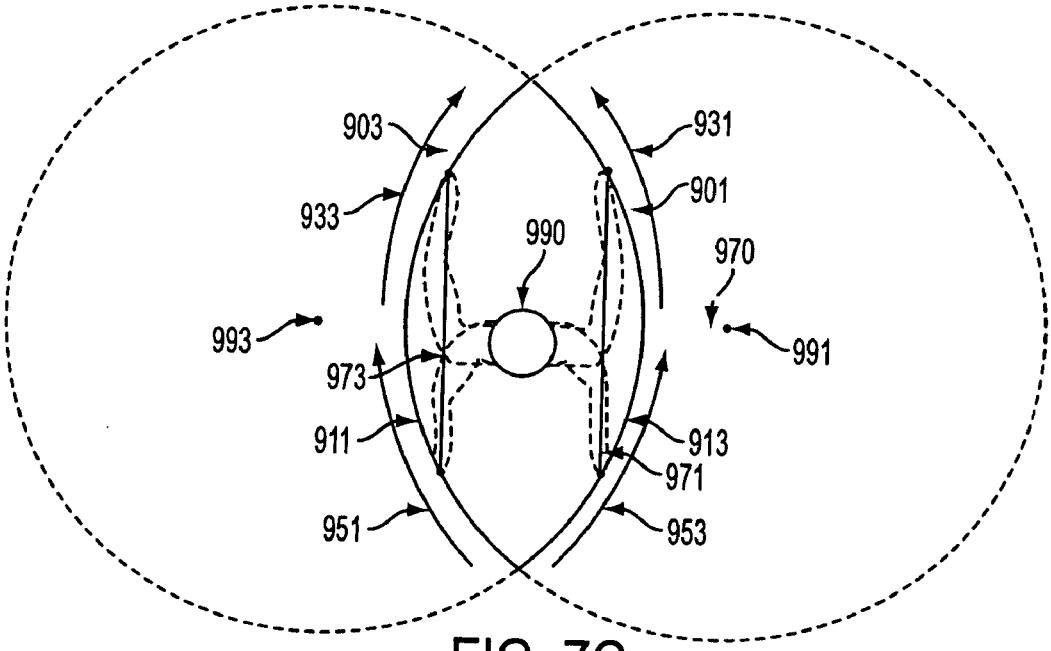
Figure 7D:
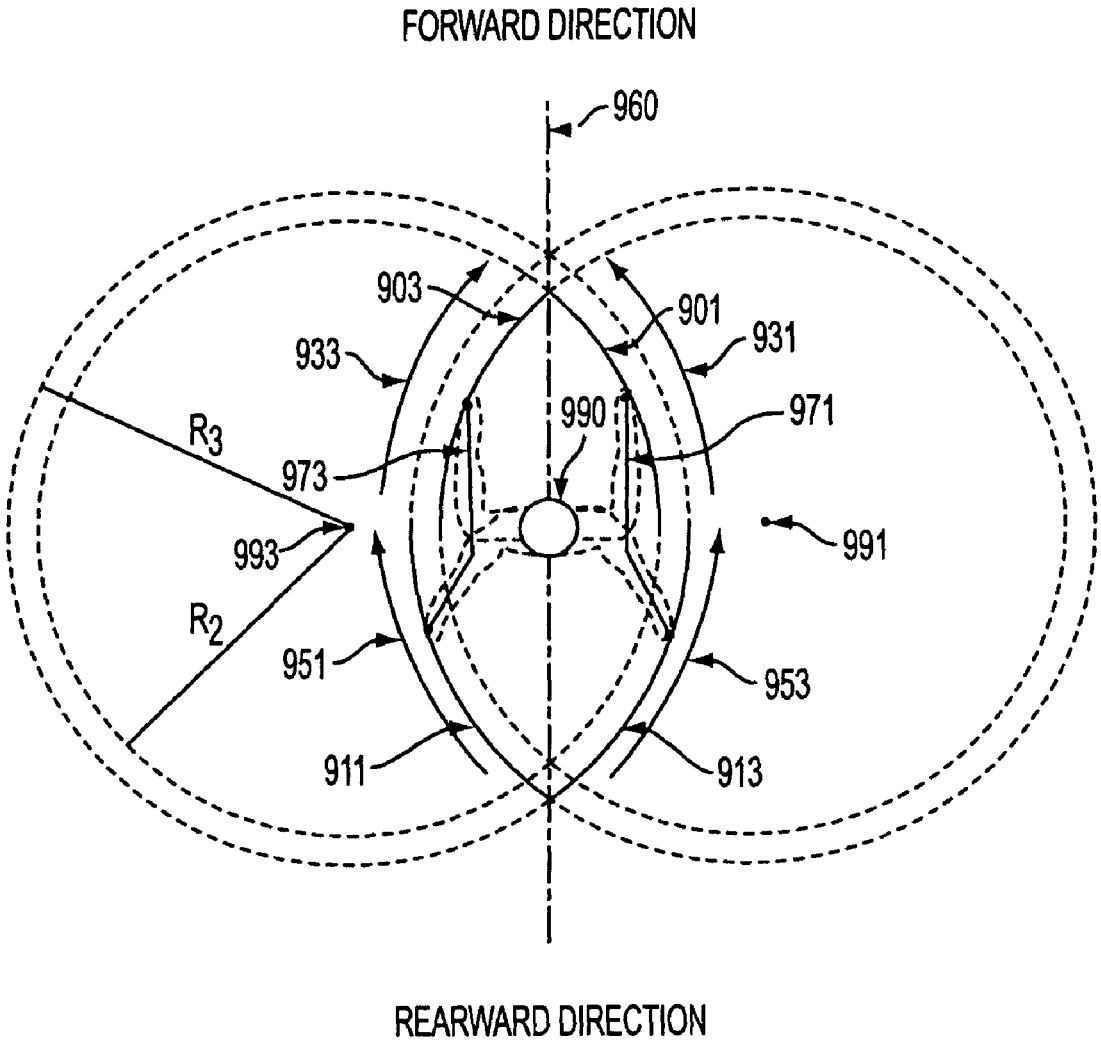
Figure 7E:
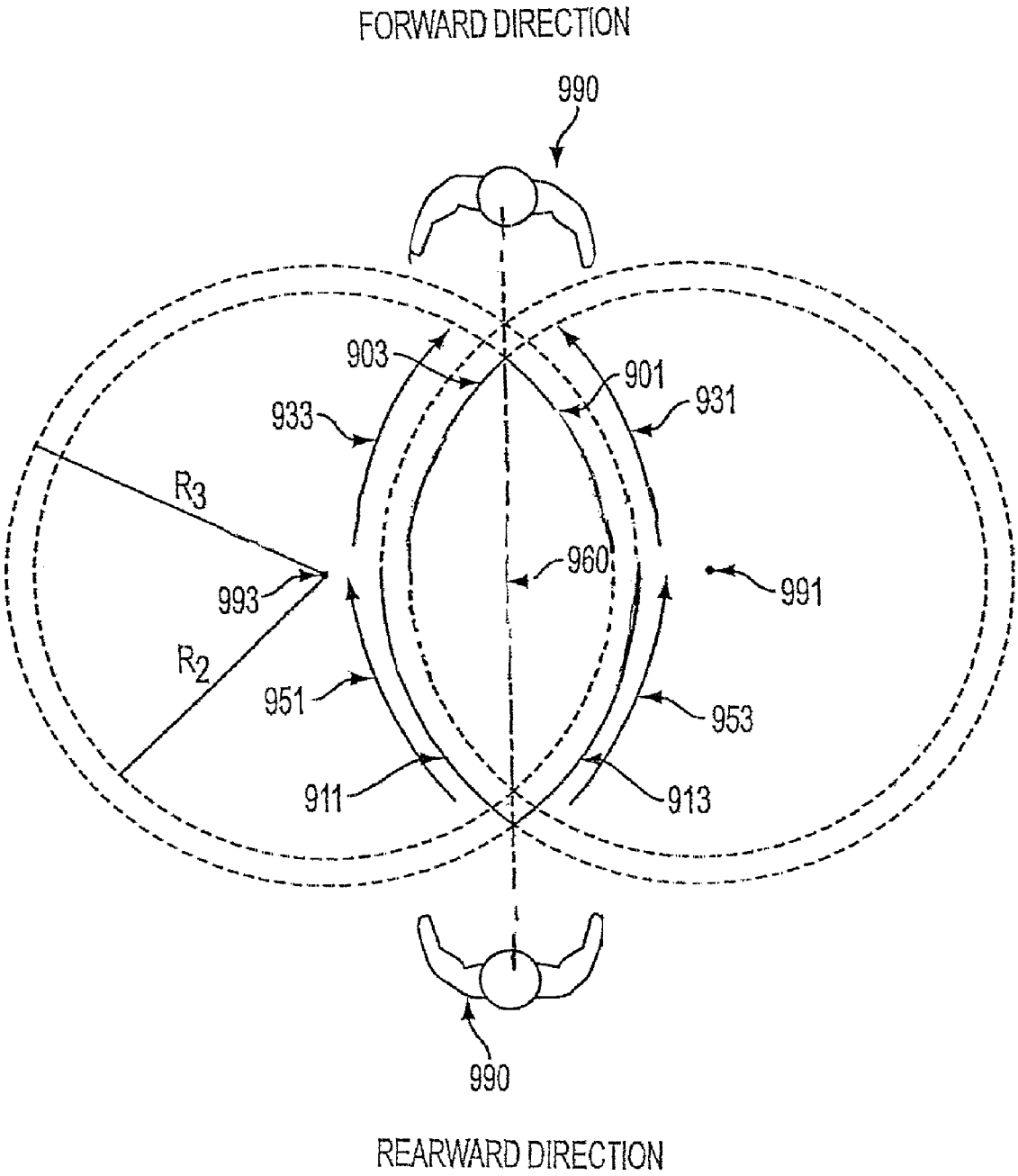

FIG. 7C now provides an embodiment of how related arcs can be used to combine the different exercises to utilize the same arm or mechanism moving on a fixed path. In particular, FIG. 7C shows how this can be performed by reversing FIG. 7B and then placing it in conjunction with FIG. 7A such that the two axes (991B) and (993B) of 7B align with the two axes (991A) and (993A) of 7A as shown by the overlapped axes (991) and (993). One of skill in the art would understand that the reversal of the arcs of 7B is not necessary and that the arcs can be placed to be related by leaving the relation the same (which would essentially have the two FIGS perfectly overlapping).

The reason for the rotation of FIG. 7B relates to motion about the axis of rotation. As was shown in FIG. 8, a rigid arm can generally only rotate about a single axis in only one direction at a time, it either rotates clockwise or counter-clockwise relative to the axis (and a fixed point of reference). As shown in FIG. 7C, the motions (931) and (953) now have a similar rotation, that is they are all rotating counter-clockwise about axis (993) while motions (933) and (951) are rotating clockwise about axis (991).

Utilizing a single rotational direction provides for numerous benefits in the exercise machine context. In particular, most exercise machines have a singular resting state where they exist when not in use. It takes force provided by the user to move the machine arms from this resting state, and generally also requires force by the user to resist the machine returning to its resting state, this is because many of the resistance objects used in exercise machines only provide force in a given direction and the direction opposing that given direction is generally what is provided by the user (through mechanical process) as the exercise. To explain simply, in the above FIG. 7C situation, generally the user will only obtain exercise by supplying a force in either the clockwise or counter-clockwise direction about any singular axis, but not both directions. Therefore, by reversing FIG. 7B, the rotational direction (clockwise for the axis (991) and counter-clockwise for axis (993)) is maintained between exercises.

One of skill in the art would recognize that in an alternative embodiment, the resistance of the resistance object can be bi-directional, allowing for force to be present in both the clockwise and counterclockwise direction, but such an arrangement generally requires a more complicated resistance object.

In FIG. 7C it is clear that by linking the starting points (generally the point of the arc that the user would begin the exercise, or the location of the point where the user interacts with the machine when the machine is in its resting state) of each of the two arcs on the same side of the FIG. together, it is possible to have each arc traversed simultaneously by points on a single rigid arm (971) or (973) which connects them and rotates about the axis (991) or (993) along a fixed path. Therefore the two "same side" arc motions can be combined into a single arm motion with two separate and distinct starting points thereon. These points would be the handle manipulation points as they generally define the motion made by the user's (990) hands performing the exercise. As is then apparent from FIG. 7C, depending on which handles the user uses (and which way they face) determines which exercise is performed.

From the simple case of FIG. 7C, by altering the shape of arm (971) or arm (973), the two points on the same side could be made to traverse different (but still related) arcs about the same axis (e.g. by altering the radius of the arcs relative to each other). This is shown in FIG. 7D. One of ordinary skill in the art would also recognize that the user's (990) hands actually use the opposing arms when the exercises are switched. This however, does not alter the motion performed as the motion of one hand for any given exercise is preferably the mirror motion of the other hand (as most humans are generally symmetrical). Therefore as the motion is generally mirrored across the plane through the user (from front to back) as illustrated in FIG. 7D as plane of symmetry (960), so long as the user maintains his/her positioning (symmetry) relative to plane of symmetry (960) when changing between exercises, the motion of each hand is the same regardless of which hand uses which arm. In another embodiment, however, non-symmetrical motion can be used where each arc is actually different from every other arc, or at least one subset of arcs is different from at least one further subset of arcs. It is preferred, however, that the user's torso maintain its symmetry relative to the plane of symmetry (960) through all movements.

The principles of FIG. 7D can be further generalized, and what becomes apparent is that a user can be placed into a multitude of positions relative to two arms on an exercise machine which each have a fixed path (one for either side of their body), where each of the arms has a plurality of places where the user can interact therewith. These can either be separate handles, or places where a single handle can be placed. The user can then grasp a set of handles at a particular location and perform a particular exercise utilizing the arms. The user could then change position and/or change the handles they are grasping to perform another exercise on a related arc while maintaining the symmetry of their torso relative to the plane of symmetry (960). For instance, the user could rotate 180 degrees, could lean at different angles forward or back, or could change using a combination of the two. In a still further embodiment, the handles could move on the arm so that they can be positioned at different points as if there was more than one handle on each arm.

This interrelated motion provides for multiple resultant exercises. In an embodiment, it is possible that an exercise machine can be built which has a single one-directional resistance object, with a single rotational attachment to a single arm and a user of the machine can perform any exercise utilizing rotational motion through an appropriate arrangement of arms, handle manipulation points, and user positions.

Such exercises are generally push or pull-type exercises that either converge or diverge. Generally, this case will involve two arms, each with the singular rotational point, so as to provide for movement of two body parts (e.g. the two hands) simultaneously. In particular, this motion can allow for subsets of related exercises to be performed on the same arms, following the same or similar paths. This saves space and allows for multiple exercises to be performed. These exercises can include, but are not limited to, chest presses, lateral pulls, rowing exercises, and shoulder presses.

FIGS. 1-6 now provide for an embodiment of an exercise machine (10) which utilizes the above principles to provide the user with at least two different exercises performed using two sets of related arcs on an arm which follows a single fixed path for both exercises. One of ordinary skill in the art would understand that other exercises could also be provided on the same machine, in particular, additional handles could be attached to either or both arms to provide additional exercises on related arcs, or additional arms or mechanisms could be added to allow a user to use the resistance object (s) to perform an unrelated exercise such as leg extension (leg curl) arm (47). One of ordinary skill in the art would also recognize that exercise machine (10) provides at least four exercises as the arms can be exercised separately (which could be considered a separate exercise). The machine in FIG. 1 is designed to perform both a converging chest press exercise and a diverging rowing exercise but one of ordinary skill in the art would understand that other exercises (such as a lateral pull) can use similar arms with changes of the orientation relative to the arms, or other related arcs provided by other handle manipulation points on those arms.

In the broadest sense, a strength machine, such as exercise machine (10), includes four components. There is some form of resistance object which provides the resistance the user works against, there is a bench which is the place where the user is placed to interact with the machine, there is a mechanism which, in conjunction with related structures, transfers the work of the user to the resistance, and there is a frame to support the structure.

FIG. 1 shows the primary components of an embodiment of an exercise machine (10). The exercise machine (10) is primarily for use in performing exercises to strengthen and/or tone the muscles of the torso and/or arms and will often be similar in design to those types of machines referred to as chest presses. The exercise machine (10) allows a user to perform both push-type, pull-type, converging, and diverging exercises for muscles primarily in the upper torso and arms by allowing a user to have two different "seating" positions to access two rigid arms, each with at least two handles or a single handle movable between two positions. Each arm is individually attached to the frame so each arm traverses an independent fixed path in conformity with the above principles.

Exercise machine (10) comprises a frame (50) which is generally manufactured of steel, aluminum, carbon fiber, or other strong and rigid construction materials. In particular, the frame (50) is generally made of hollow tubes composed of these materials. For the purposes of this disclosure, it should be recognized that a tube can have any shape as a cross-section and can be either hollow or solid. Therefore the term "tubes" as used herein should be considered to include any solid or hollow structure having any cross-sectional shape. In an embodiment, at least some of the tubes are hollow and have a cross-sectional shape which is generally in the shape of a race track.

The frame (50) comprises a base member (101) which serves as the primary support for the remaining components and rests upon a surface where the exercise machine (10) is to be placed. In the depicted embodiment, base member (101) is generally T-shaped to provide for a stable base, however other shapes of the base member (101) could be used as would be understood by one of ordinary skill in the art. The rest of frame (50) extends generally vertically from the base member (101) and is supported by the base member (101) to define the general shape of the machine.

Figure 4:
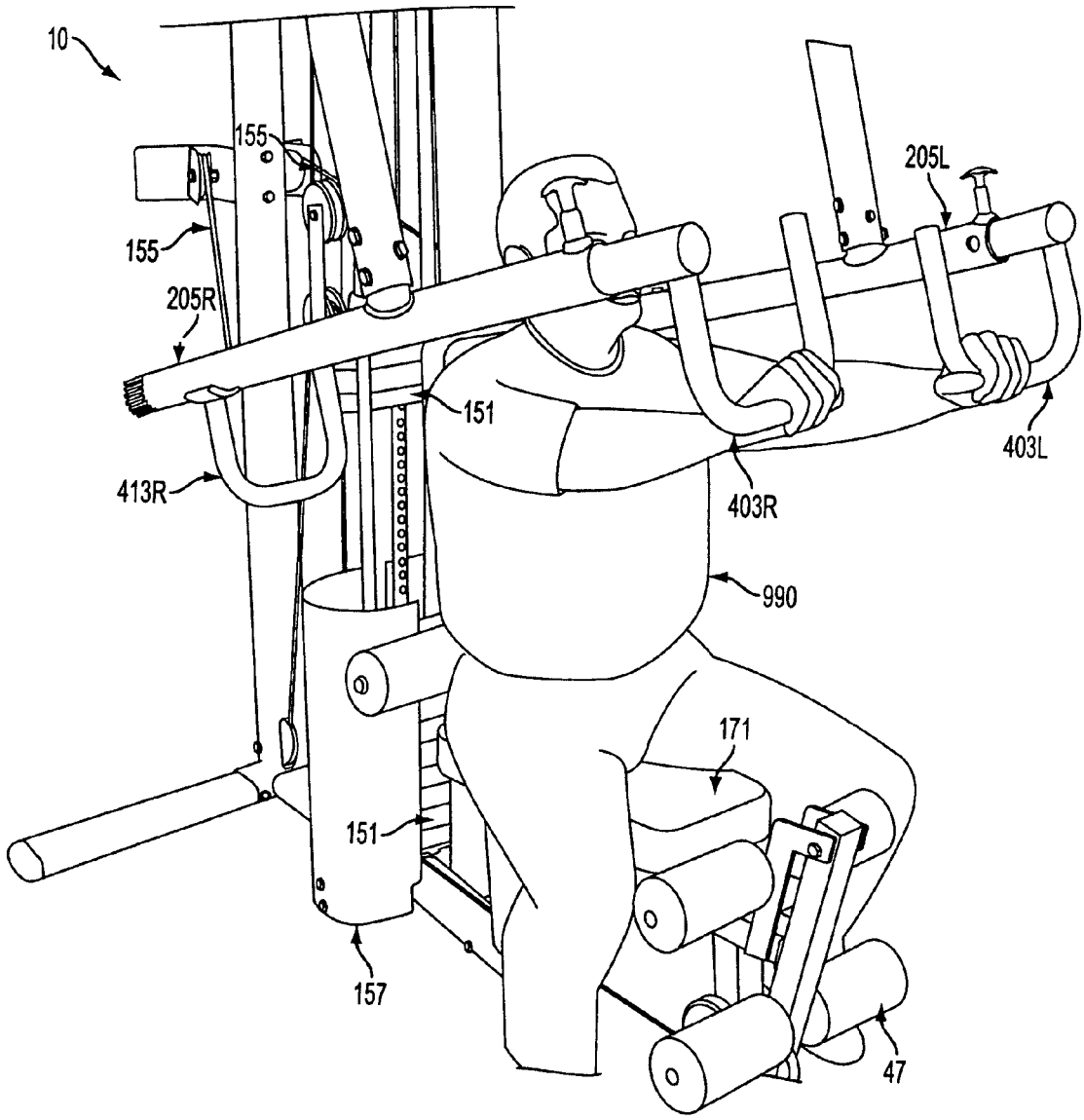
FIG. 4 depicts a user positioned on the embodiment of FIG. 1 at the apex point of a push-type exercise, specifically a converging chest press.

Associated with frame (50) there are weights (151) or other resistance object(s) for providing resistance to the user's movement so that the movement requires work and results in exercise. In the depicted embodiment, weights (151) are in a weight enclosure (159) when at rest. Resistance is created by weights (151) being lifted in an upward direction forcing the movement of the mass of the weights (151) against the force of a gravitational field (e.g. as shown in FIG. 4). As would be understood by one of ordinary skill in the art, the lifting of weights (151) is not the only way to create work and other resistance object(s) could be used instead of or in addition to weights (151). These include, but are not limited to, fluid devices (such as pneumatic or hydraulic pistons) where work may be used to extend or contract, elastic materials where work alters the shape or alignment of the material (such as elastics, rubber bands, springs, or bendable tubes), friction devices, electromagnetic devices, or any combination of different resistance objects.

In an embodiment, the resistance object(s) will only provide resistance in a single direction. Specifically, the resistance object will have a singular resting state where it will exist unless a force is applied to it. Using weights (151), the weights (151) will rest on the base member (101) or a shelf (not shown) attached to base member (101) under the force of earth's gravitational field (the resting state). Weights (151) can be lifted to raise them from the base member (101), but this lifting requires the imposition of another force on weights (151). Weights (151) will also return to the resting state if the other force is removed. To put this another way, a one-way resistance object is affected by a returning force to return it to a resting state. To move the resistance object from the resting state, therefore, the user must generate an "exercise force" to oppose the returning force of the resistance object. Some of these returning forces can include, but are not limited to, gravity, pressure differential, or the return force of a spring.

In another embodiment, the resistance object can be a two-way or bi-directional resistance object. This type of a resistance object allows for a resistance force to be generated in both directions. A method of achieving this is if the object has no defined resting state, but instead always requires the imposition of an exercise force to move the object from any state to any other state. Examples of this type of two-way resistance objects can include pressure cylinders (such as pneumatic or hydraulic cylinders) where the material in the cylinder is allowed to flow to either side of the piston head through a restrictive opening. There is, therefore, always resistance to motion as the piston head will displace the material regardless of the direction it is moved. Generally two-way resistance objects will utilize friction, pressure, surface tension, or similar resistances. Another method is where the object has a defined resting state, but is moved from this state by moving a mechanism in different directions, such as through the use of gearing, clutches, levers, or other mechanisms.

Weight support bars (153) are provided which run through holes in the weights (151) and secure them to frame (50) and position them relative to base member (101). As weight support bars (153) are generally perpendicular to the base member (101), when the weights (151) are lifted they are forced to be lifted in a generally linear manner, and are not allowed to swing which could render the exercise machine (10) unstable. In an alternative embodiment, however, weight support bars (153) may be angled, curved, bent, arcuate or of any other relationship which is not perpendicular to allow for a more dynamic feel to the exercise. Weight support bars may also be flexible instead of rigid, may allow different degrees of freedom or may be completely non-existent in alternative embodiments.

Weights (151) are generally lifted through an application of force onto the arms (205R) and/or (205L) which are what transfers the work performed by the user to the resistance object upon which the work is performed. The arms (205R) and/or (205L) are mechanically connected to frame (50) in a manner allowing them to move relative to the frame along a fixed path. While the path may change between exercises, the path remains fixed during any singular exercise. A fixed path need not be identical in every pass. Instead, in a fixed path the motion of the arc is within a fixed subset of predetermined paths or is a singular path. Preferably, each of the arms (205R) and/or (205L) is connected rotatably at a rotation surface (306R) and/or (306L) so that each independently rotates through a unique fixed path and are both connected to the weights (151) in a manner where the predetermined rotation of the arms (205R) and/or (205L) is translated into motion for raising the weights (151).

In another embodiment, the arms (205R) and/or (205L) need not be attached about a rotational axis, but may be otherwise attached so as to provide for a fixed path of motion corresponding to predetermined arcs being traced by handles (403R), (413R), (403L), and (413L). This may be, but is not limited to, having the arms (205R) and/or (205L) traverse along a track or similar object of a predetermined shape (regardless of shape) so as to direct the motion of the arms. For instance, a point on the arm could follow the path of a hyperbolic or linear arc. In another embodiment, the arm could traverse multiple tracks so that the resultant motion of a point on the arm where the handle is located follows the desired arc. For instance, the arm could be supported at each end within a linear track so that translation of one end necessarily results in a translation of the other end (possibly in opposing directions) and a handle on the arm moves on a predetermined arc (whether curved, bent or linear). In still a further embodiment, a single arm could be connected by other components to rotate about multiple axes, such as by having the arm rotate utilizing two connector arms rotatably connected thereto and rotatably connected to the frame (a 4-bar mechanism) in a manner that would be understood by one of ordinary skill in the art.

The direction of the applied exercise force can be translated from the direction that the user directs it (which is generally arcuate), to a direction opposing the returning force (which is generally vertically upward in the case of weights (151) being the resistance). In the depicted embodiment, this connection comprises pulling a cable or cables (155) attached to the arms (205R) and (205L) at cable attachments (255R) and (255L). In another embodiment, cable (155) could actually comprise the arms (205R) and/or (205L). The cables' (155) motion is translated by pulleys (157) until it is transferred to weights (151) in a lifting motion. One of ordinary skill in the art would, however, understand that cables (155) and/or pulleys (157) are not necessary and other processes could be used so that moving arms (205R) and/or (205L) requires the performing of work by the user. This translation of force merely allows for an exercise force applied by the user to be directed in a desired direction, it does not change the one-way or two-way nature of the resistance object.

In particular, for the device of FIG. 1, the returning force of the weights (which are a one-way resistance object) will pull the arms (205L) and (205R) in a generally backward direction, therefore the user would provide a force in a generally forward direction to perform the exercise. The terms backward and forward are arbitrarily assigned in this case with backward representing generally the direction left and into the page of FIG. 1 and forward being the opposite relative to the exercise machine (10). For simplicity's sake, the direction of the exercise force will be defined as the direction of force provided by the user, not the direction after it is translated by the connector associated with the arms (205L) and (205R). However, neither these definitions, nor any other, are intended to limit the scope of the terms as would be understood by one of ordinary skill in the art.

In order to effectively manipulate arms (205L) and (205R), each arm is provided with at least two handles. However, in another embodiment, only a single handle on each arm is used which can be moved between at least two positions. The handles comprise handles (403L) and (413L) for left arm (205L) and handles (403R) and (413R) for right arm (205R). The handles (403L), (413L), (403R), and (413R) provide the points that the user will grip when performing the exercise, therefore the range of motion of the various handles relative to the user will define the path that the user's hands take when performing the exercise. Also attached to frame (50) is a bench (171) which is generally positioned so as to place the user relative to the arms (205R) and/or (205L) for performing the exercise. In an alternative embodiment, bench (171) need not be attached to frame (50) but may be positionable relative to frame (50) or not present at all.

Figure 3:
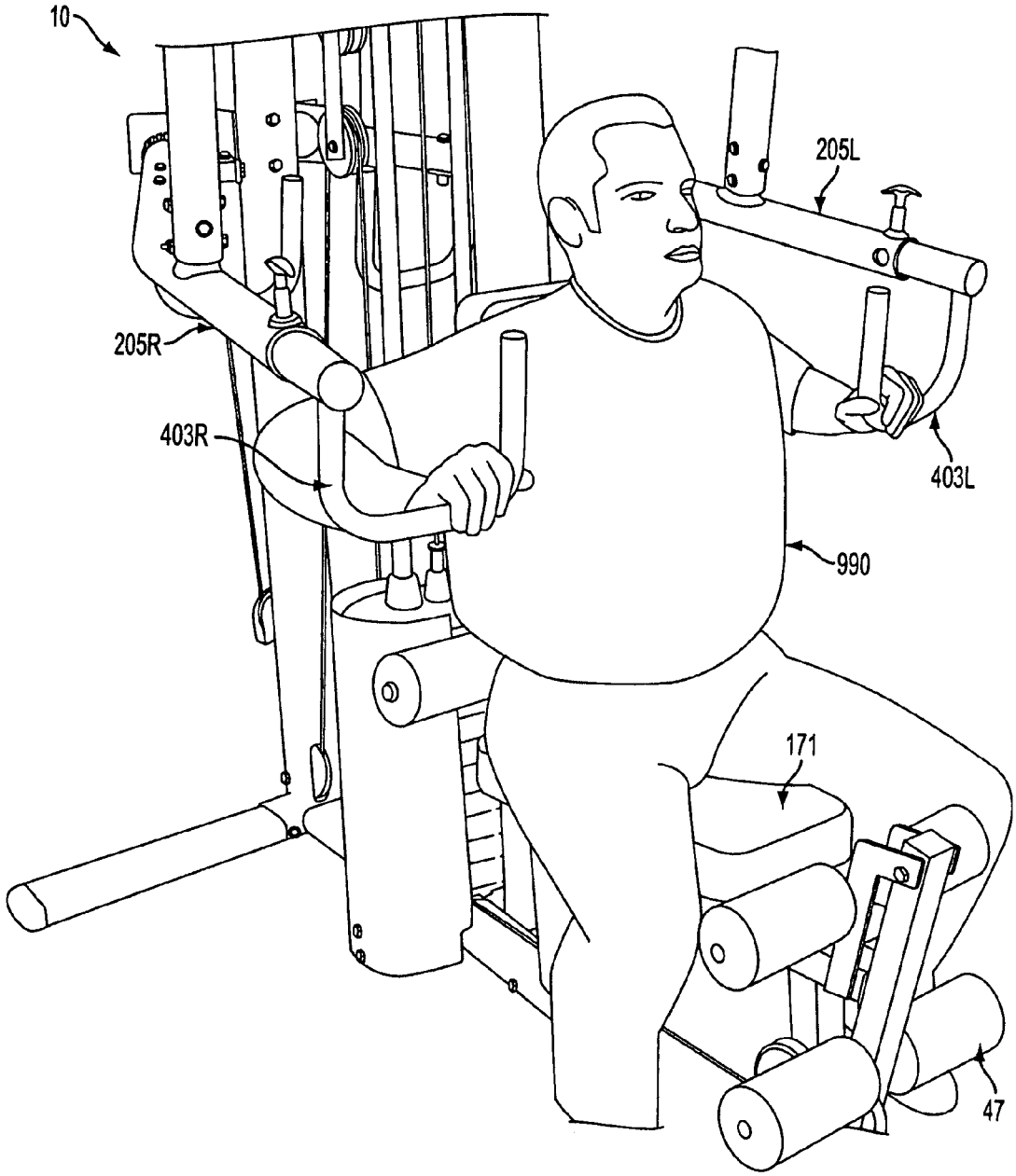
FIG. 3 depicts a user positioned on the embodiment of FIG. 1 at the start point for a push-type exercise, specifically a converging chest press.
Figure 5:
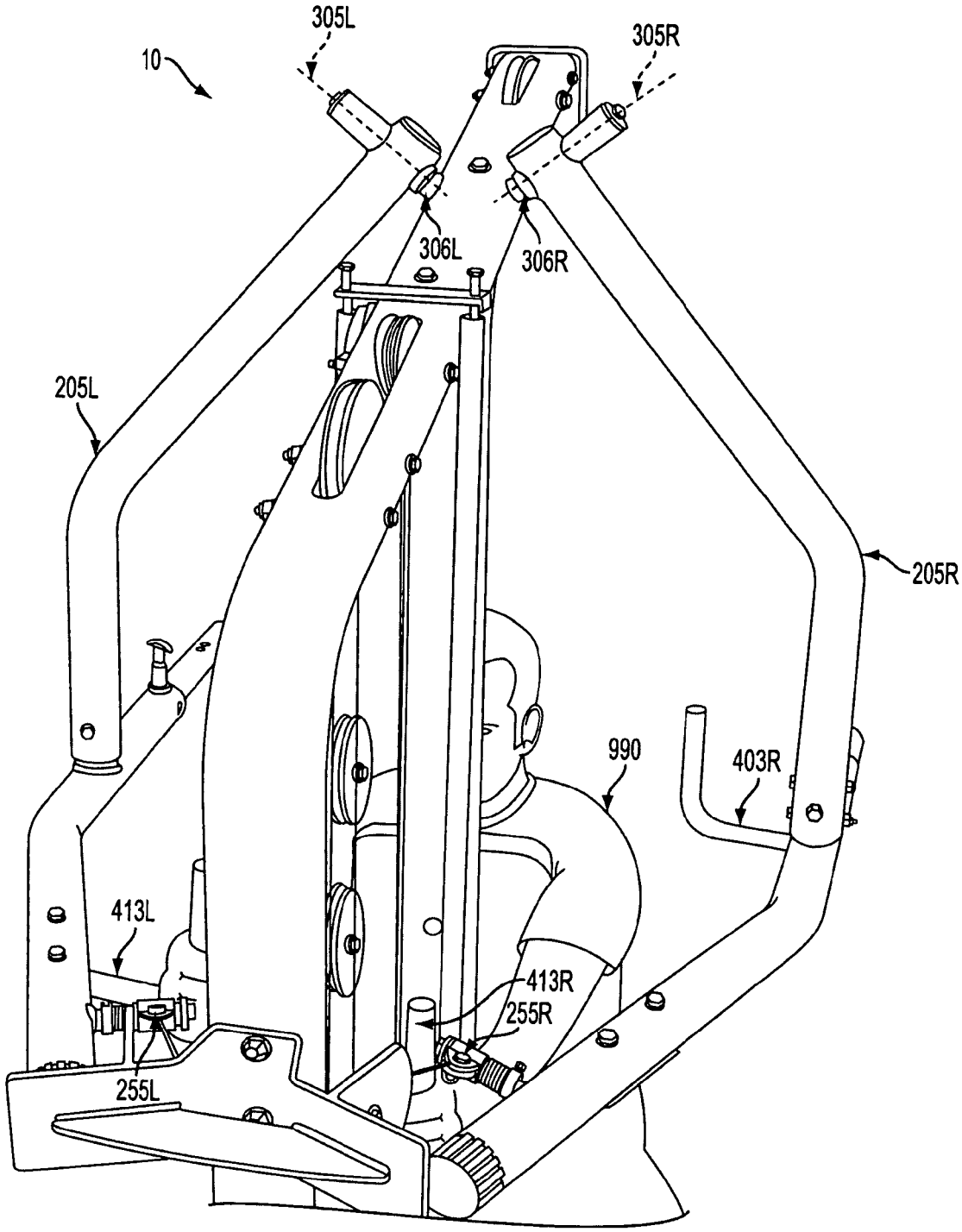
FIG. 5 depicts a user positioned on the embodiment of FIG. 1 at the start point for a pull-type exercise, specifically a diverging rowing exercise.
Figure 6:
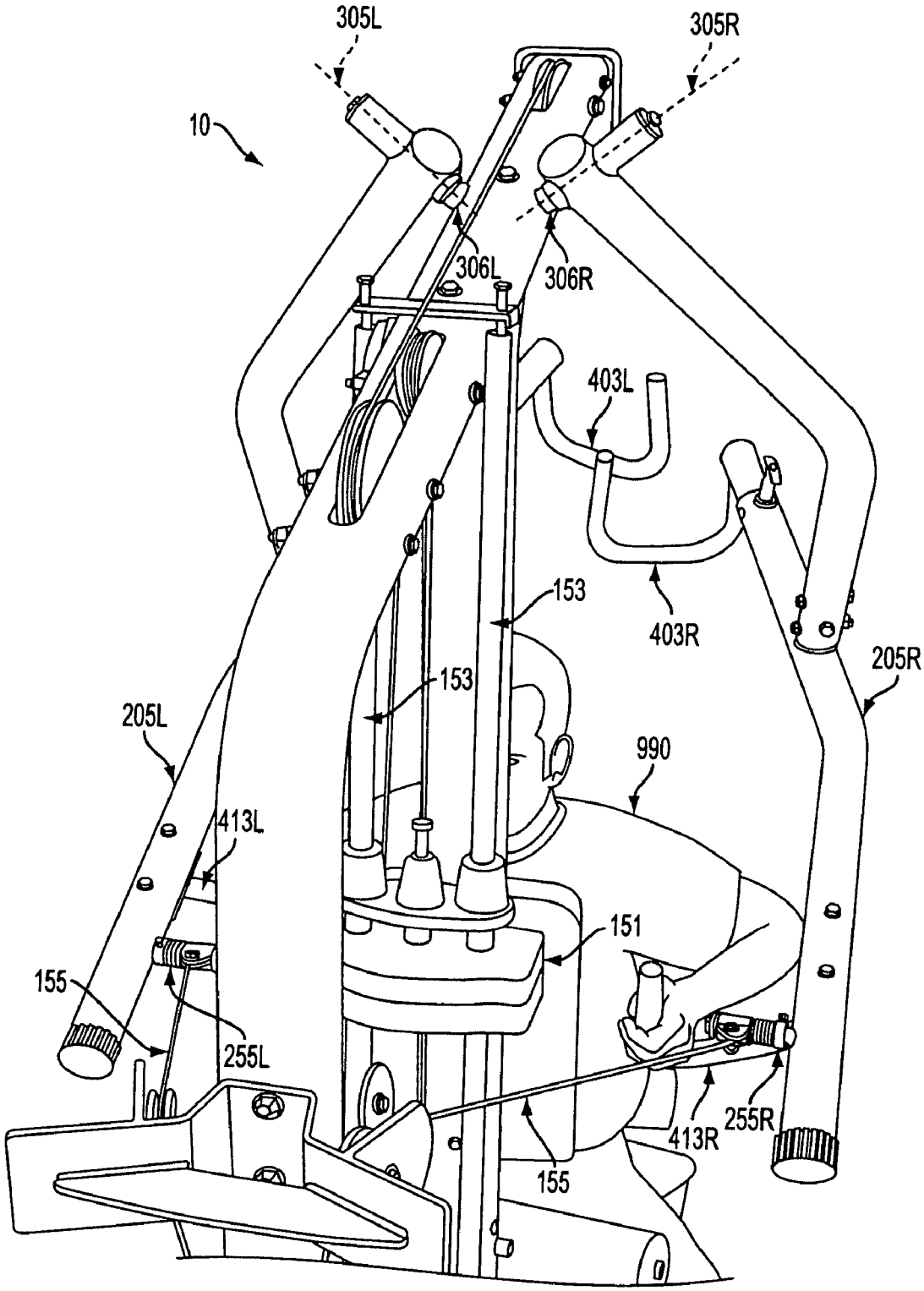
FIG. 6 depicts a user positioned on the embodiment of FIG. 1 at the apex point of a pull-type exercise, specifically a diverging rowing exercise.

FIGS. 3 through 6 show how exercise machine (10) allows the user to rotate to perform two different exercises (as previously shown in FIGS. 7C and 7D in a general overview) and utilizing two pairs of handles (4 total), one pair reachable for each position and two on each of two arms. To accomplish this rotation, the bench (171) may allow for two different positionings of the body. In the depicted embodiment, in one position, the user faces forward on the machine. In this position, they will be performing push-type converging exercises. A user in this position is shown in FIGS. 3 and 4. In the alternative position, the user is reversed and would be sitting facing backward, this position will generally be used for pull-type diverging exercises. A user in this second position is shown in FIGS. 5 and 6 (from a reverse angle). The user may be rotated a full 180 degrees as shown in this embodiment, or may simply be facing the opposite direction, but placed at a different angle to be reversed. In effect, by changing the position of the user the user can access a different set of handles and can perform exercises where their motion is in a different direction to them while the exercise force is always generated in the same direction. This generally corresponds to the motion depicted in FIG. 7D.

Although the bench in the depicted embodiment of FIGS. 1 through 6 is fixed in position and the user rotates (reverses) thereon that is by no means required. In another embodiment, the bench (171) may be adjustable relative to the frame (50) to allow for comfortable manipulation of the arms (205L) or (205R) at the different sets of handles (403L) (403R) and (413L) (413R). In the depicted embodiment, the bench (171) has two portions, a back portion (173) and a seat portion (175). Either of these portions may be adjustable on the frame moving in any or all directions (horizontal, vertical, lateral axes or combination thereof) or rotations to allow the user to position themselves for comfortable exercising. In an embodiment, the bench (171) is designed to have a singular predetermined position for a user which is used for both exercises. To put it another way, the user does not move the bench (171) when going from a pull-type to the corresponding push-type exercise. In another embodiment, the back portion (173) may remain in a predetermined position relative to the seat portion even if the seat portion (175) moves or vice versa. In still another embodiment, the bench (171) can be reversed like the user, or can be placed in a complementary position (such as by reversing the back portion (173)). Generally, the position of the bench (171) will be lockable so that when the bench (171) is placed in a particular position, it can be held there rigidly until the user wishes it to move. This type of locking may be performed through a plurality of methods, as would be understood by one of ordinary skill in the art.

The user need not sit upright in the bench (171) (as depicted in FIGS. 3-6). In an alternative embodiment, the back portion (173) could be capable of rotation. Particularly, the back portion could rotate to an angle relative to the vertical. In this position, the user could also perform an incline or shoulder push-type exercise by rotating the bench forward (changing the alignment of their torso to the path of the handles). An associated pull-type exercise may be performed using the same arrangement but with a transition to deal with a complementary angle issue if the exercise occurs at an angle. In this embodiment generally the bench will rotate with the user between the exercises. It would be recognized that the "rotation" discussed above need not be a rotation at all but simply could be any reconfiguring of the components of the bench (171) or the use of an additional bench.

As the user rotates between the two positions, the handles they will use are preferably in front of them which is part of why this embodiment uses both a rotation of the user and different sets of handles to provide for the different exercises. One of skill in the art would recognize, however, that depending on the exercise being performed (the desired arc and arc direction) and the type of resistance object used, either the user, the handles, or both could be repositioned between exercises depending on the embodiment. It should be clear that the user's torso maintains its symmetry relative to a fixed plane through the various movements.

In simplification, each handle (403L), (403R), (413L), and (413R) is generally positioned so as to traverse one of the arcs (901), (911), (903) and (913) as shown in FIG. 7D starting at the appropriate points (the actual arcs are slightly more complicated, but this shows some general concepts). In particular, handle (403R) generally traverses arc (901), handle (403L) generally traverses arc (903), handle (413R) generally traverses arc (913), and handle (413L) generally traverses arc (911) all in the indicated directions.

Further, while FIGS. 3 through 6 show the performance of the above two exercises, it should be appreciated that by moving the user relative to the handles, with arm motion along a singular fixed path, the user can perform virtually any exercise. In particular, in FIG. 7D the user could be moved to the forward-most part of the circles and then face rearward to perform a converging pull-type exercise using the same handle he used for the converging push-type exercise as shown in 7E.

When performing the exercise, the user would generally operate the machine as shown in FIGS. 3 through 6. To perform a push-type exercise the user would arrange the bench (171) to a position for the type of exercise they wish to perform to a comfortable location. They would then take a first position on the bench (171) facing forward of the machine (10) and grasp push handles (403R) and (403L). They would then push away from their body, moving arms (205R) and (205L) forward against resistance. This is depicted as the transition of FIG. 3 to FIG. 4. To perform a pull-type exercise, the user would again arrange bench (171). However, they would take a second position facing backward to the machine (10) (rotated 180 degrees) where they would grasp pull handles (413R) and (413L) and pull them toward their body. Grasping and pulling pull handles (413R) and (413L) from this second position would move arms (205L) and (205R) forward against resistance in a similar motion as the push-type exercise. This motion is depicted as the transition of FIG. 5 to FIG. 6. FIGS. 5 and 6 are from a reverse angle to FIGS. 3 and 4 to better show the motion of the user and machine.

It should be further apparent from FIGS. 3 through 6 that the handle sets (403R)/(413R) and (403L)/(413L) will traverse the same arc regardless of which handle on the particular arm is being moved, presuming that the handles are not moved relative to each other (such as in the case to avoid impact as discussed later) when switching which handle is being moved. Further, the user can select other positions relative to the arms to perform different exercises by moving the bench and/or their body to other locations relative to the arms (or by adjusting the frame to have the same net result).

The design of the arm (205R) is discussed in more depth to explain an embodiment of structure which allows for the handles to each traverse the desired arcs. While this discussion will primarily discuss the design of right arm (205R), the left arm (205L) is essentially a mirror image of the right arm (205R). It would therefore be understood by one of ordinary skill in the art how to adapt the discussion below concerning the structure of right arm (205R) to making the left arm (205L). To provide for reference to the components of the arms, the same reference numbers will be used on the right arm (205R) as the left arm (205L) while letters will denote the particular arm being discussed. E.g., (403R) indicates the push handle specifically on the right arm (205R) while (403L) indicates the push handle specifically on the left arm (205L).

Figure 2:
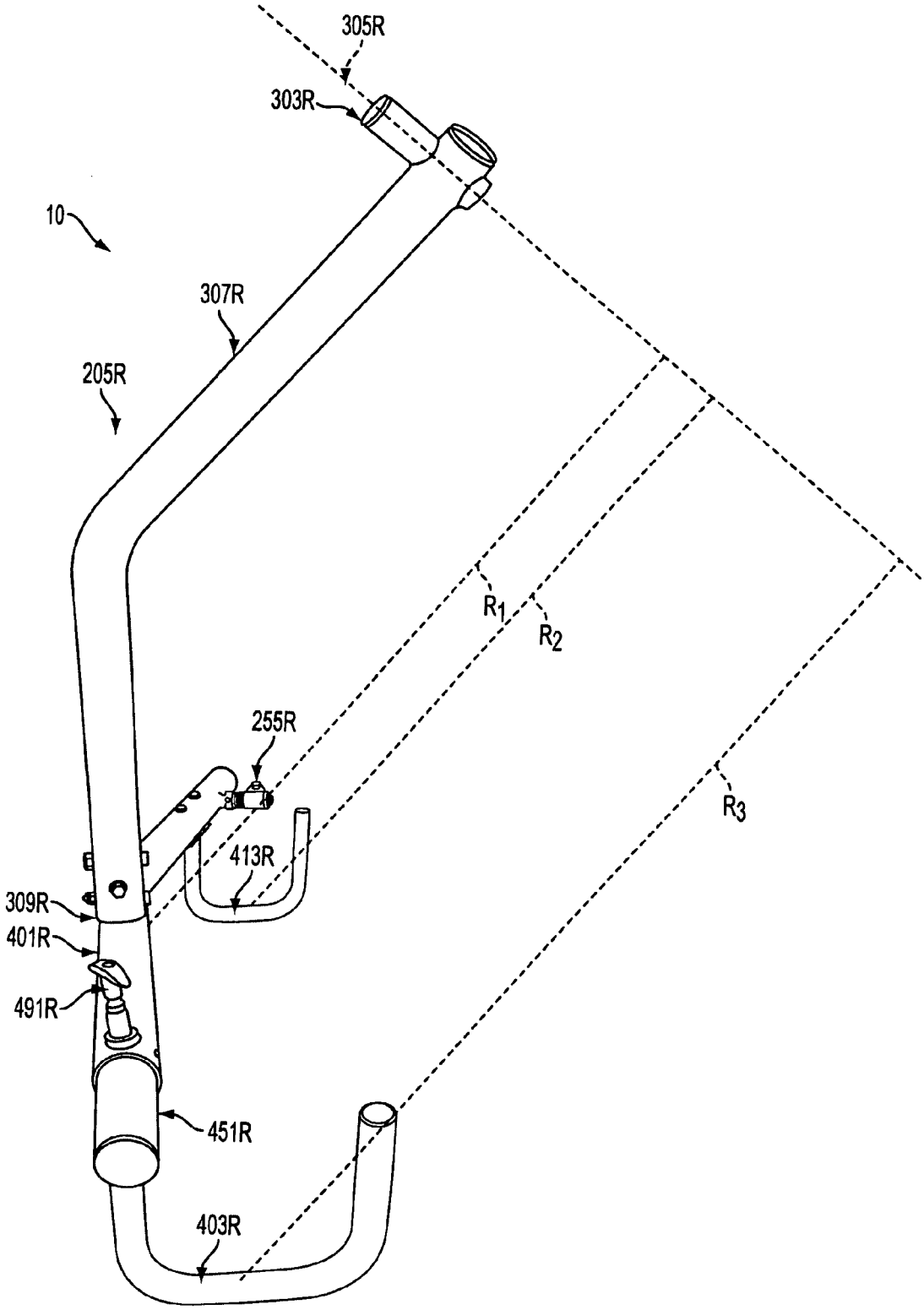
FIG. 2 depicts a detail view of an embodiment of an arm from the embodiment of FIG. 1.

As shown in FIG. 2, the right arm (205R) is composed of three primary subparts. The lever tube (307R), the adjustment arm (401R), and the extension tube (451R). The first two portions are generally rigidly attached to one another to form part of the structure of right arm (205R) with extension tube (451R) slideably attached thereto. Right arm (205R) is preferably of a rigid or semi-rigid construction or one with otherwise limited variance to its shape. Right arm (205R) rotates about a pivot point relative to frame (50). The pivot point is created by having a pivot tube (303R) which is allowed to rotate about (or to rotate with) a smaller inner core (not visible) or other rotational object. The rotation is relative to a portion of the frame (50) so that there is a singular fixed axis of rotation (305R) of right arm (205R). In another embodiment, alternative forms of mechanisms may be used to provide rotation, or other movement on a fixed path.

Attached to pivot tube (303R) is lever tube (307R). Lever tube (307R) is arranged to be generally radially extended from the axis of rotation (305R) to provide for a lever motion along a radial of the axis of rotation (305R). The lever tube (307R) may be bent into an angle to provide for a point of attachment (309R) appropriately positioned for attachment of the adjustment arm (401R). Because attachment point (309R) is resultantly radially extended (by $R_1$) relative to the axis of rotation (305R) (e.g. it is not on the axis of rotation (305R)), the point of attachment (309R) transcribes an arc around the axis of rotation when moved.

Attached to lever tube (307R) at attachment point (309R) is adjustment tube (401R). Adjustment tube (401R) will generally be attached to the lever tube (307R) at an approximately 90 degree angle forming a "T" shape, but any arrangement may be used. In this way, the approximate center of adjustment tube (401R) will be generally tangential to the arc transcribed by the connection point (309R). The adjustment tube (401R) may be bent, however, as shown in FIG. 2. This bending can be utilized to adjust the particular shape and/or size of the arc traversed by the handle (403R) attached to extension tube (451R) and handle (413R) attached to adjustment tube (401R). This is as shown in FIG. 7D, for instance, with adjustment tube (401R) essentially being arm (971) and is indicated by the handles being $R_2$ and $R_3$ distances from the axis of rotation (305R). Adjustment tube's (401R) bent shape allows for the placement of handles thereon which have different radiuses of rotation at different positions in space around axis of rotation (305R) by moving the points where a handle is connected closer to or further from the axis of rotation (305R) changing the radius of the resultant arc (as shown by radiuses $R_2$ and $R_3$) and placing the handle connection points so the resultant arcs are in the proper position for performing the desired exercise. Further, the adjustment tube (401R) may allow for alteration of the arc being used (by changing $R_2$ and/or $R_3$) and/or translation of the starting points on a resultant arc.

Attached to the extension tube (451R) is a push handle (403R) while attached to the adjustment tube (401R) is a pull handle (413R) (which may be adjustable thereon). The push handle (403R) is mounted on the forward of the lever tube (307R), while the pull handle is mounted backward of the lever tube (307R). This arrangement allows for a prescribed range of motion such as that shown in FIGS. 3-6. In particular, each handle will transcribe an arc, these arcs may be slightly larger or smaller than the arc transcribed by connection point (309R) depending on the orientation (bending) of the adjustment tube (401R). By bending the adjustment tube (401R) as shown, the handles can also be placed on the arc which is or would be transcribed by the attachment point (309R) or on any other arc. In an embodiment, the handles could transcribe portions of the same arc, but that arc could be different from the arc transcribed by the connection point. In another embodiment, each handle could transcribe its own arc. These alternative embodiments can allow for adjustment of the relative motions of the handles (403R) and (413R) to accommodate changes in the motion for push-type versus pull-type exercises and to allow for the lever arm (307R) to be positioned so as to be clear of the user throughout its motion.

Associated with the adjustment tube (401R) is cable connection (255R) which is located toward the backward end of the adjustment tube (401R). Cable connection (255R), as discussed previously, provides for the connection between the cable (155), to which the weights (151) are ultimately attached, and the adjustment tube (401R). The cable connection's (255R) location provides for the returning force provided by the weights (151) to be directed backward of the machine (10) providing that the exercise force provided by the user should be generally horizontal and in the forward arcuate direction of the machine (10) as discussed earlier.

In the depicted embodiment, the push handle (403R) is mounted on an adjustable extension tube (451R) which can slide relative to adjustment tube (401R) (such as into and out of adjustment tube (401R)). This allows for users of different body sizes to adjust the position of the push handle (403R) to better accommodate the size of their body. In another embodiment, the adjustment can allow for the inclusion of additional exercises on the arm. Further, the adjustment of the push handle (403R) and (403L) allows for the arms (205R) and (205L) to miss each other when the pull-type exercise is being performed. Generally, when the pull-type exercise is being performed, it will be preferable for the push handles (403L) and (403R) to be able to "swing through" a larger arc than when the push handles (403L) and (403R) are being actively used. In particular, it is desirable for the push handles (403L) and (403R), if arranged for use in a push-type exercise, to cross when the arms (205L) and (205R) are used for a pull-type exercise. As the handles (403L) and (403R) are usually rigid, this is not generally possible. If the push handles (403L) and (403R) are located on extension tubes, the handles (403L) and (403R) can be extended to different distances or the handles (403R) and (403L) can be rotated outward. For example, push handle (403L) can be extended further than push handle (403R). In this way, when the arms (205R) and (205L) are rotated during a pull exercise, the handles (403L) and (403R) will miss interacting with each other allowing for a slightly larger motion for the pull-type exercise, than in the push-type exercise. Further, it prevents the user from receiving an unwelcome shock when, during a pull-type exercise, the push handles (403R) or (403L) hit.

FIG. 6 shows how arranging the arms (205L) and (205R) to different lengths allows handles (403L) and (403R) to miss each other. This motion is basically the same as that of FIG. 7D, however, the arcs traced are all slightly larger when the handles are offset and the position of the arc (903) for the handle which is extended in FIG. 6, corresponds to the position that handle would have been in if not moved, not the position it is in.

The extension tube (451R) may be connected with the adjustment tube (401R) through a locking mechanism using a spring pin, a cotter pin or another type of object (491R) which can fit through a hole in the extension tube (451R) and a corresponding hole in the adjustment tube (401R). In another embodiment, an alternative locking mechanism other than a hole and pin can be used as would be understood by one of ordinary skill in the art.

The two handles (403R) and (413R) are generally of the same shape. In the depicted embodiment, the handles are generally U-shaped. This is only one of many embodiments of handle (403R) and/or handle (413R) as they can assume virtually any shape as well as shapes different from each other. Further, the handles may be of the same shape but differently oriented relative to the rest of the arm (205R). Handle (403R) or (413R) is generally gripped by the user in their hand and is the contact point for the transference of the force generated by the user to the exercise machine (10) to perform the work to lift the weights (151). The depicted design of the handles (403R) and (413R) are preferred because they allow for a more natural grip for performing the desired exercises. In particular, the user can grip either vertical portion of the handle (403R) or (413R). A user could alternatively grasp the horizontal portion of the handle (403R) or (413R).

Figure 9:
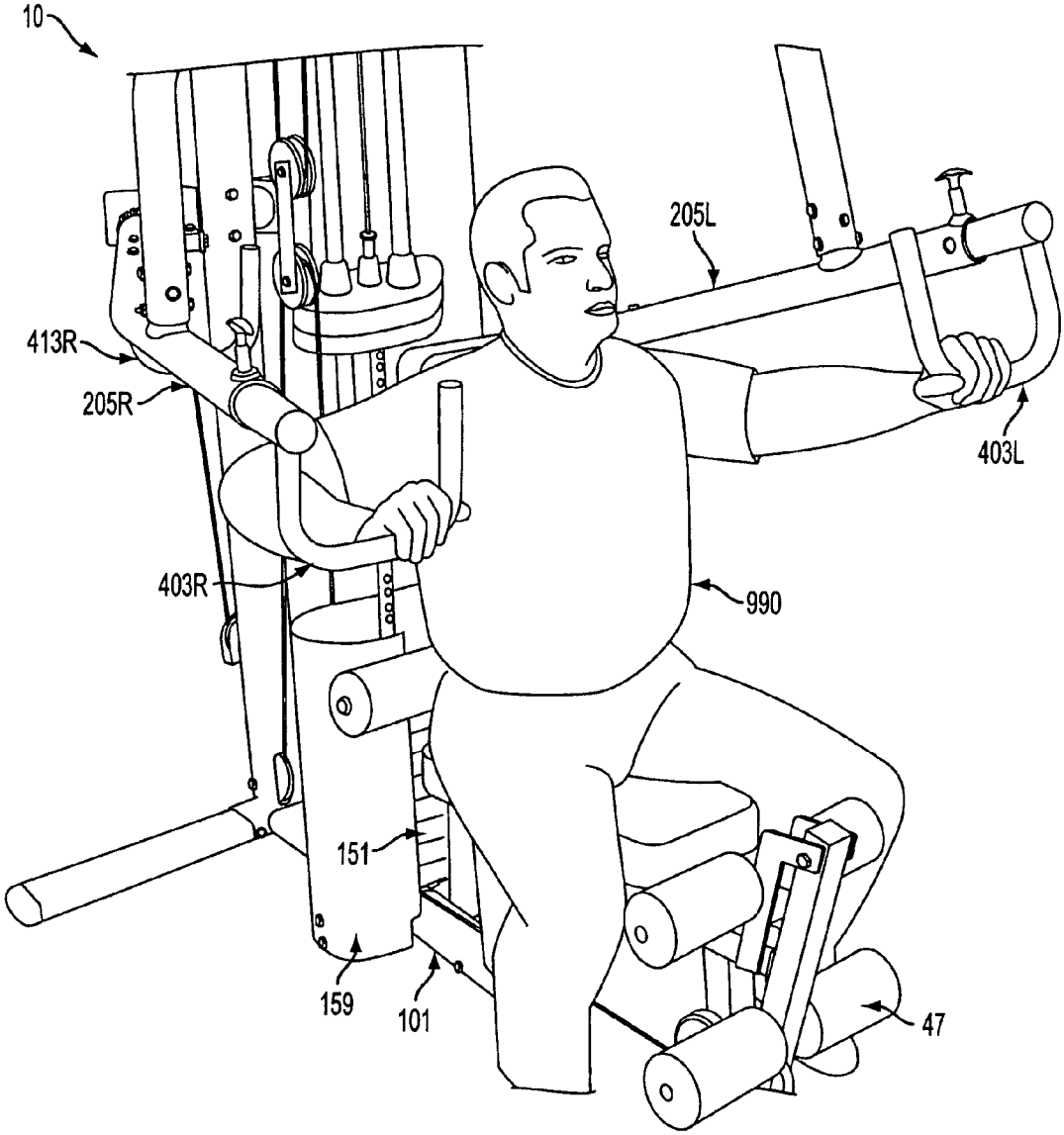
FIG. 9 depicts a user at the apex point of a converging push-type exercise using a single arm on the embodiment of FIG. 1.

Generally, the two arms (205L) and (205R) will move independent of each other as they each rotate about a different axis of rotation (305L) or (305R). This can allow the user to more easily isolate a muscle group on either the left or right side of their body. Further, independent motion will help to insure that each arm is performing work involved in the exercise to improve the overall results and prevent one stronger arm from overly compensating for the other. In still another embodiment, the individual motion can allow for the total weight being lifted to be split evenly between the arms. This independent operation is demonstrated in the embodiment depicted in FIG. 9. FIG. 9 shows an embodiment of an exercise machine (10) with one arm raised and the other arm lowered with a user at the apex of a single arm push-type converging exercise. As discussed above, this exercise is still a converging exercise as the motion of the single arm is identical to that when the hands converge. A singular arm pull-type exercise could also be performed. In still another embodiment, the arms could be connected to make their motion dependent.

Figure 10:
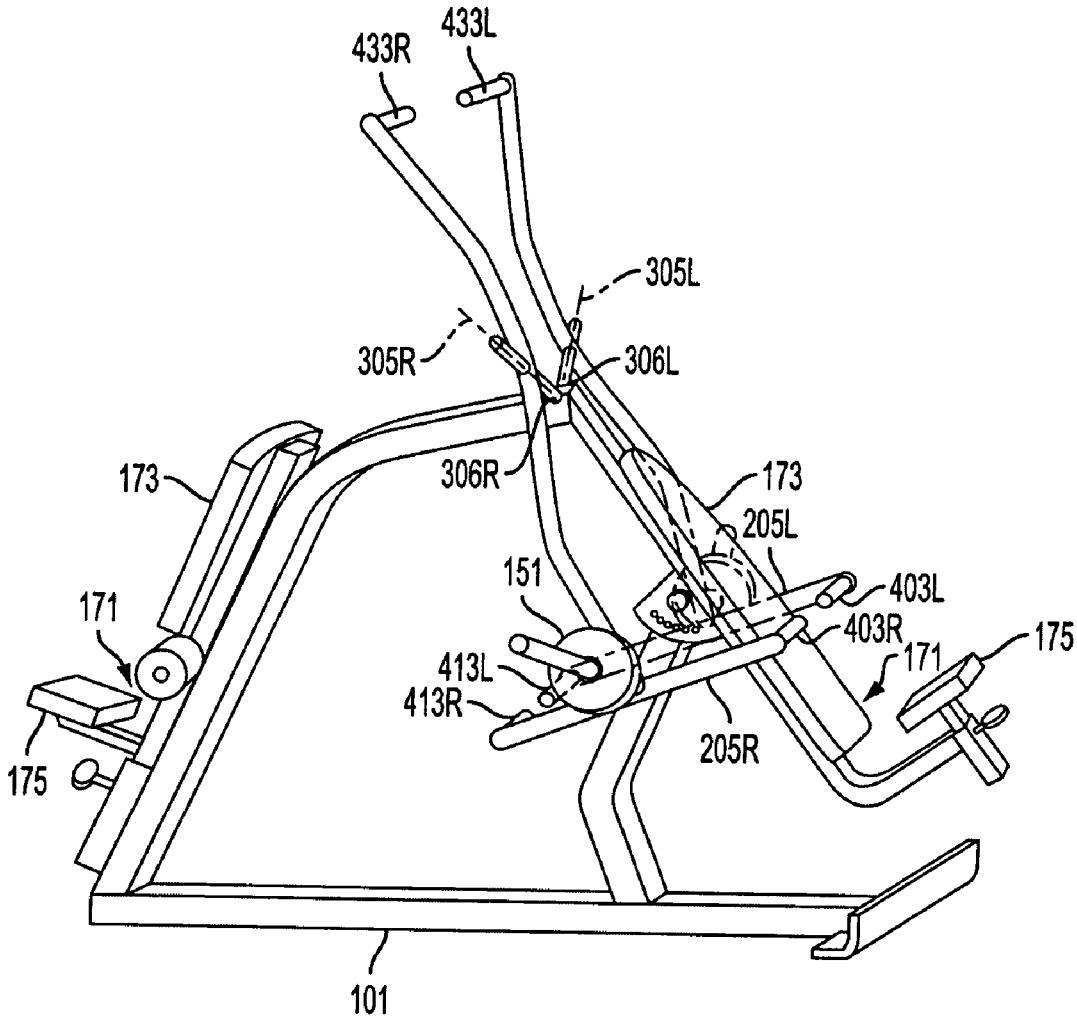
FIG. 10 depicts a perspective view of another embodiment of an exercise machine incorporating another embodiment of arms allowing for multiple types of exercises.

FIG. 10 provides for another embodiment of an exercise machine utilizing arms of a different design, a different type of resistance mechanism, and two benches. This embodiment, however, still utilizes the same principles of motion allowing for a single arm to have multiple points of interaction with a user to perform multiple exercises. This machine provides two arms (205R) and (205L). However, in this embodiment there are two benches (171) and each arm (205R) and (205L) includes three sets of handles (403R) and (403L), (413R) and (413L), and (433R) and (433L) to provide for three different exercises including a converging chest press, a diverging row, and a diverging lateral pull. Further, in the embodiment of FIG. 10, the weights (151) are placed directly on the arms (205R) and (205L) eliminating the need for the pulley system shown in the embodiment of FIG. 1.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. An exercise machine comprising:

a frame;

a resistance object;

a first arm moveably attached to said frame to rotate about a first axis, said first arm also being connected to said resistance object;

a second arm moveably attached to said frame to rotate about a second axis said second arm also being connected to said resistance object;

a handle attached to said first arm and positioned at a push handle position so as to traverse a portion of a fixed path about said first axis;

a handle attached to said second arm and positioned at a push handle position so as to traverse a portion of a fixed path about said second axis;

a handle attached to said first arm and positioned at a pull handle position so as to traverse a portion of a fixed path about said first axis;

a handle attached to said second arm and positioned at a pull handle position so as to traverse a portion of a fixed path about said second axis; and a bench having a seat portion attached to said frame;

wherein said first axis and said second axis are not parallel to each other;

wherein said path about said first axis traversed by said handle attached to said first arm at said push handle position and said path about said second axis traversed by said handle attached to said second arm at said push handle position intersect;

wherein said path about said first axis traversed by said handle attached to said first arm at said pull handle position and said path about said second axis traversed by said handle attached to said second arm at said pull handle position also intersect;

wherein a user on said seat portion and facing forward on said machine manipulates said handles in said push positions on each of said arms to perform a push-type exercise resisted by said resistance object; and wherein said user on said seat portion and facing backward on said machine manipulates said handles in said pull positions on each of said arms to perform a pull-type exercise resisted by said resistance object.

2. The exercise machine of claim 1 wherein said push-type exercise comprises a converging exercise.

3. The exercise machine of claim 2 wherein said pull-type exercise comprises a diverging exercise.

4. The exercise machine of claim 3 wherein said pull-type exercise comprises a rowing exercise.

5. The exercise machine of claim 4 wherein said push-type exercise comprises a chest exercise.

6. The exercise machine of claim 4 wherein said resistance object resists said push-type exercise in the same direction as said resistance object resists said pull-type exercise.

7. The exercise machine of claim 6 wherein said first arm and said second arm each move independently of the other.

8. The exercise machine of claim 7 wherein said handle attached to said first arm and positioned at a push handle position and said handle attached to said first arm and positioned at a pull handle position comprise different handles.

9. The exercise machine of claim 8 wherein the movement of said handle attached to said first arm and positioned at a pull handle position causes movement of said handle attached to said first arm and positioned at a push handle position.

10. The exercise machine of claim 1 wherein said push-type exercise comprises a converging exercise and said pull-type exercise comprises a diverging exercise.

11. The exercise machine of claim 1 wherein said handle attached to said first arm and positioned at a push handle position and said handle attached to said first arm and positioned comprise different handles.

12. The exercise machine of claim 1 wherein said first arm and said second arm each move independently of the other.

13. The exercise machine of claim 1 wherein said seat portion is in generally the same horizontal position when said user faces forward as when said user faces backward.

* * * * *